US005235947A

United States Patent [19]

Watanabe

[11] Patent Number: 5,235,947

[45] Date of Patent: Aug. 17, 1993

[54] SYSTEM AND METHOD FOR CONTROLLING IDLING SPEED FOR INTERNAL COMBUSTION ENGINE

[75] Inventor: Satoru Watanabe, Gumma, Japan

[73] Assignee: Japan Electronic Control Systems Co., Ltd., Isezaki, Japan

[21] Appl. No.: 971,177

[22] Filed: Nov. 4, 1992

[30] Foreign Application Priority Data

Nov. 6, 1991 [JP] Japan ..... 3-289970

[51] Int. Cl.[5] ..... F02D 41/16

[52] U.S. Cl. ..... 123/339

[58] Field of Search ..... 123/339

[56] References Cited

U.S. PATENT DOCUMENTS 4,635,601 1/1987 Cornelius ..... 123/339

5,069,181 12/1991 Togai et al. ..... 123/339 X 5,121,725 6/1992 Araki ..... 123/339

FOREIGN PATENT DOCUMENTS 60-188840 12/1985 Japan .

*Primary Examiner*—Tony M. Argenbright

*Attorney, Agent, or Firm*—Foley & Lardner

[57] ABSTRACT

A system and method for controlling an engine idling speed for an internal combustion engine are disclosed in which during the setting of a differential control value $ISC_d$ based on a variation speed in an actual engine revolution speed Ne, an accumulation of the differential control value $ISC_d$ is carried out. The final accumulated value Ds of the differential portion $ISC_d$ is held from a time at which $ISC_d=O$ to a time at which a predetermined period of time T has passed, the predetermined period of time T being previously set according to a response characteristic of an idling control valve. A stepping motor is used for the idling control valve located in an auxiliary intake air passage bypassing an engine throttle valve. The integration control value $ISC_i$ is updated so that the value which accords with the final accumulated value Ds is added to an integration control value $ISC_i$. Thus, a feedback control of the engine idling speed according to the PID (proportional-integration-differential) control is sufficiently carried out.

10 Claims, 3 Drawing Sheets to

Ns

Ne

P

I
T

D

SYSTEM AND METHOD FOR CONTROLLING IDLING SPEED FOR INTERNAL COMBUSTION ENGINE

BACKGROUND OF THE INVENTION

1. Field of the Invention

The present invention relates generally to a system and method for controlling an idling speed for an internal combustion engine.

2. Description of the Background Art

A Japanese Utility Model Registration Application First Publication No. Showa 60-188840 published on Dec. 14, 1985 and a U.S. Pat. No. 5,121,725 issued on Jun. 16, 1992 exemplify previously proposed idling speed controlling systems in which an idling control valve is disposed in an auxiliary air passage bypassing a throttle valve so as to adjust an auxiliary air quantity, thus controlling the idling speed to a target engine revolution speed.

A stepping motor has been used to drive the above-described idling control valve. In this case, a pulse train signal whose number of pulses and phase are determined on the basis of the engine revolution speed is supplied to the stepping motor, thereby adjusting an opening angle of the idling control valve.

The number of pulses supplied to the idling control valve is determined according to a control value $ISC_{on}$ calculated using the following equation (1):

$$ISC_{on}=ISC_{tw}+ISC_{fb} \quad (1)$$

wherein $ISC_{on}$ denotes a basic control value determined depending on a coolant temperature (hereinafter, referred to as a water temperature) and $ISC_{on}$ denotes a feedback correction value.

For a feedback control of the idling speed, a comparison is made between, e.g., an actual revolution speed detected by a crank angle sensor and a target revolution speed which is dependent on the water temperature detected by the water temperature sensor. If there is a difference therebetween, the idling speed is controlled to provide the target revolution speed in which the feedback correction value $ISC_{on}$ is added to the instantaneous control value $ISC_{on}$.

In addition, the feedback correction value $ISC_{fb}$ is set according to the result of proportional-integral (PI) control. To increase a speed responsive characteristic, the differential portion (D) is added which is based on the change speed in the actual revolution speed so as to be set according to the proportional-integration-differential (PID) control.

However, in a case where the stepping motor is used which provides a slower responsive characteristic for the idling control valve than in the previously proposed idling speed control system, the feedback correction value $ISC_{fb}$ is set according to the proportional-integral-differential (PID) control so as to carry out the feedback control. During an interval at which the differential portion is added, however, the actual revolution speed does not change so largely that an effect of adding the differential portion to the set feedback correction value cannot sufficiently be achieved.

SUMMARY OF THE INVENTION

It is, therefore, a principal object of the present invention to provide a system and method for controlling an idling speed for an internal combustion engine, which can improve the control responsive characteristic for the idling control valve.

The above-described object can be achieved by providing an idling speed control system for an internal combustion engine, comprising: a) an idling control valve whose opening angle is adjusted in response to a control signal, said idling control valve being disposed on an auxiliary air passage bypassing a throttle valve of the engine; b) basic control value setting means for setting a basic control value of the adjusted opening angle of the idling control valve; c) proportional control setting means for setting a proportional control value to correct the basic control value so that an actual engine revolution speed approaches a target engine revolution speed, the proportional control value being set on the basis of a difference between the actual revolution speed and target revolution speed; d) integration control setting means for setting an integration control value to correct the basic control value so that the actual engine revolution speed approaches the target engine revolution speed, the integration control value being set on the basis of the difference between the actual revolution speed and target revolution speed; e) differential control setting means for setting a differential control value to correct the basic control value so that the actual engine revolution speed approaches the target engine revolution speed, the differential control value being set on the basis of the variation speed of the actual engine revolution speed; f) control value calculating means for calculating a control value of the adjusted opening angle of the idling control valve by adding the integration control, proportional control, and differential control values to the basic control value; g) differential control value accumulating means for accumulating the differential control values during an interval at which the differential control value is set; h) accumulated value holding means for holding a final accumulated value at a time at which the setting of the differential control value is ended for a predetermined period of time after the time at which the setting of the differential control value is ended; and i) integration updating means for adding the value which accords with the final accumulated value of the differential control value to the integration control value during the predetermined period of time at which the final accumulated value at the time of end of setting the differential control value is held.

The above-described object can also be achieved by providing an idling speed control method for an internal combustion engine, comprising the steps of: a) basic control value setting means for setting a basic control value of an adjusted opening angle of an idling speed control valve, said idling speed control valve being disposed in an auxiliary air passage bypassing an engine throttle valve for controlling an auxiliary air quantity during an engine idling condition; b) setting a proportional control value to correct the basic control value so that an actual engine revolution speed approaches a target engine revolution speed, the proportional control value being set on the basis of a difference between the actual revolution speed and target revolution speed; c) setting an integration control value to correct the basic control value so that the actual engine revolution speed approaches the target engine revolution speed, the integration control value being set on the basis of the difference between the actual revolution speed and target revolution speed; d) setting a differential control value to correct the basic control value so that the actual engine revolution speed approaches the target engine revolution speed, the differential control value being set on the basis of the variation speed of the actual engine revolution speed; e) calculating a control value of the adjusted opening angle of the idling control valve by adding the integration control, proportional control, and differential control values to the basic control value; f) accumulating the differential control values during an interval at which the differential control value is set; g) holding a final accumulated value at a time at which the setting of the differential control value is ended for a predetermined period of time after the time at which the setting of the differential control value is ended; and h) adding the value which accords with the final accumulated value of the differential control value to the integration control value during the predetermined period of time at which the final accumulated value at the time of setting end of the differential control value is held.

DESCRIPTION OF THE PREFERRED EMBODIMENT

Reference will hereinafter be made to the drawings in order to facilitate a better understanding of the present invention.

Figure 1:
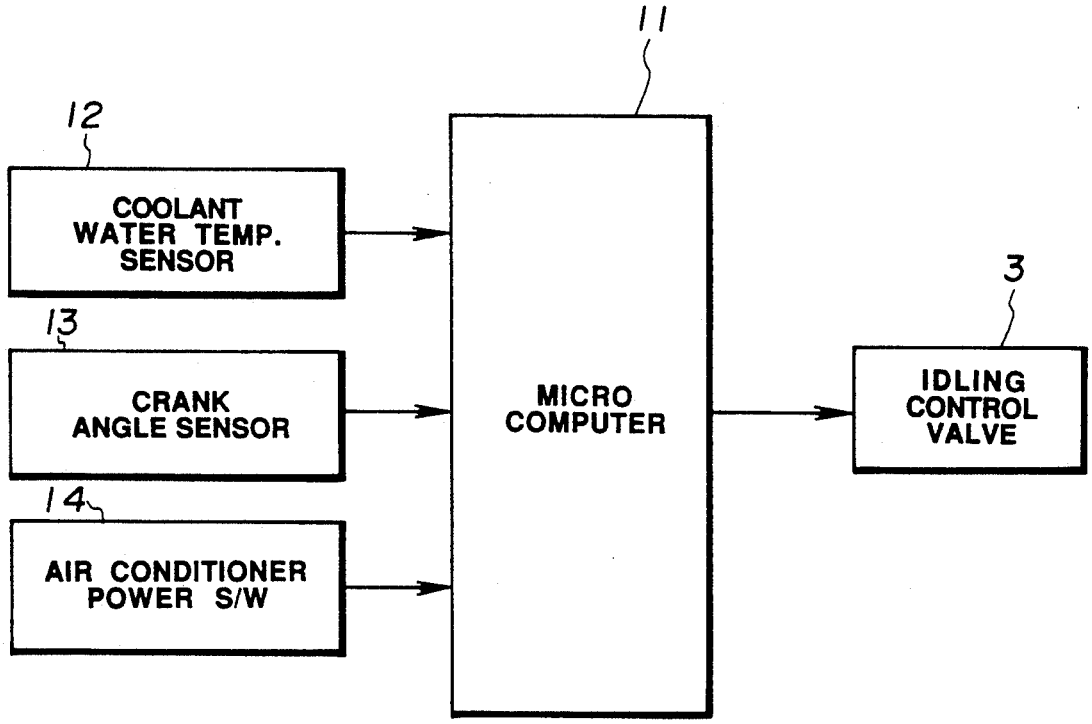
FIG. 1 is a circuit block diagram of a system for controlling an idling speed for an internal combustion engine in a preferred embodiment according to the present invention.

FIG. 1 shows a circuit block diagram of an idling speed control system for a vehicular internal combustion engine.

As shown in FIG. 1, a microcomputer 11 (including a CPU, RAM, ROM, and I/O interface) receives engine coolant temperature signal from a water temperature sensor 12; a crank angular position signal from a crank angle sensor 13; and an ON or OFF signal from a switch 14 of an air conditioner mounted in the vehicle.

A stepping motor is used as, e.g., an idling speed control valve 3. Generally, the stepping motor provides an unfavorable response characteristic due to its pulse driven mode of operation.

An opening angle of the idling control valve 3 is adjusted according to a number of pulses and its phase of a pulse train signal supplied thereto. The number of pulses and phase are determined on the basis of the revolution speed of the engine and so on upon the execution of a control routine shown in FIG. 2.

Figure 2:
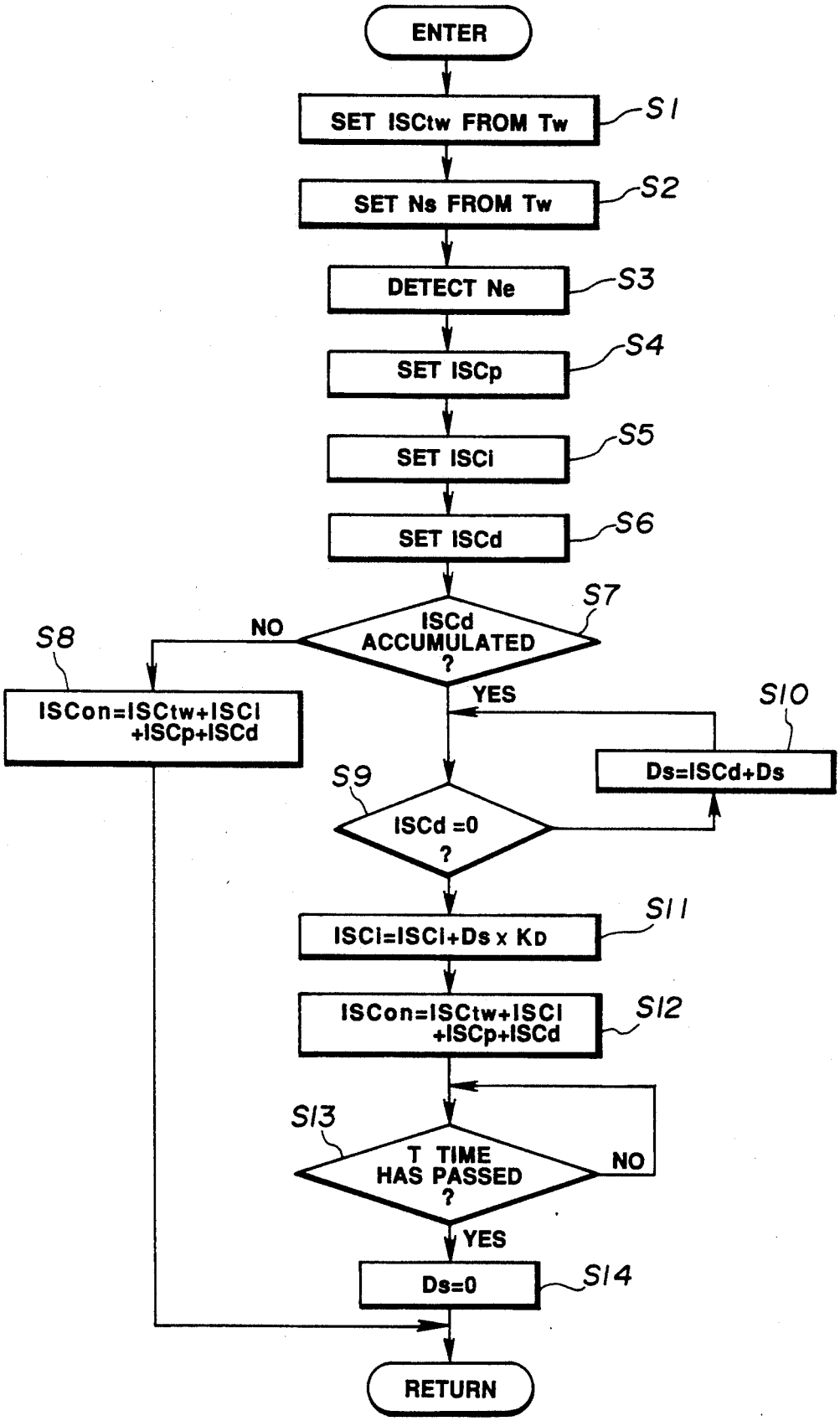
FIG. 2 is an operational flowchart for executing a control procedure by means of a control unit (microcomputer) in the preferred embodiment shown in FIG. 1.

FIG. 2 shows the control routine of the idling speed executed by the microcomputer 11.

In a step S1, the microcomputer 11 sets a basic control value $ISC_{tw}$ of the idling control valve 3 on the basis of the water temperature detected by the engine coolant temperature sensor 12.

In a step S2, the microcomputer 11 sets a target engine revolution speed Ns from the ON-OFF signal from the switch 14 of the air conditioner and water temperature detected by the engine coolant temperature sensor 12.

That is to say, in a case where such an accessory device as the air conditioner which provides a large electric load for the engine, the engine revolution speed is generally increased.

Figures 3A, 3B, 3C, 3D, 3E:
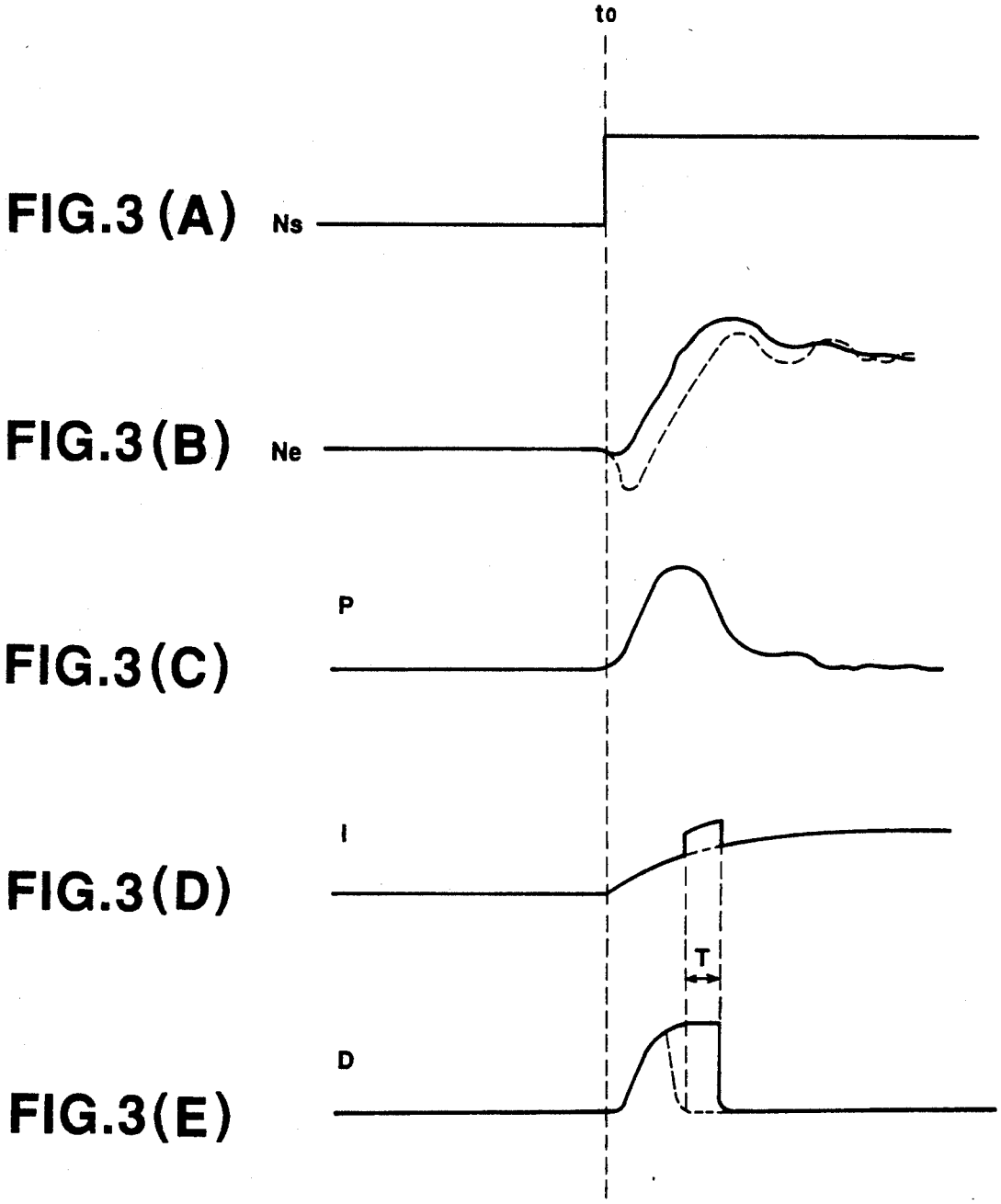
FIGS. 3 (A) through 3 (E) are characteristic graphs of the result of the control carried out by the idling controlling system shown in FIG. 1.

Therefore, as shown in FIG. 3 (B), when the air conditioner is turned on at a time of $t_0$, a target engine revolution speed Ns is set on the basis of the water temperature so as to be further increased.

In a step S3, the actual revolution speed Ne is detected on the basis of the position signal input from the crank angle sensor 13.

In a step S4, the microcomputer 11 sets the proportional portion (control value) $C_p$ on the basis of a difference between the actual revolution speed Ne and target revolution speed Ns.

In a step S5, the microcomputer 11 sets an integration portion (control value) $ISC_i$ comparing the actual engine revolution speed Ne and target revolution speed Ns.

In a step S6, the microcomputer 11 detects a variation speed of the actual engine revolution speed Ne and sets the differential portion (control value) $ISC_d$ according to the variation speed.

In a step S7, the microcomputer 11 determines whether an accumulation of the differential portion $ISC_d$ is carried out.

When the accumulation of the differential portion $ISC_d$ is not carried out, the routine goes to a step S8 in which the control value $ISC_{on}$ toward the idling speed control valve 3 is calculated in accordance with the following equation (2). The pulse train signal based on the control value $ISC_{on}$ is output to the idling control valve 3.

$$ISC_{on}=ISC_{tw}+ISC_i+ISC_p+ISC_d \quad (2)$$

In a step S9, the microcomputer 11 determines whether $ISC_d=0$.

If $ISC_d \neq 0$, the routine goes to a step S10 in which the differential portion $ISC_d$ is accumulated to calculate the accumulated value of $D_s$.

The accumulation of the differential portion $ISC_d$ is carried out until $ISC_d=0$.

If $ISC_d=0$ in the step S9, the routine goes to a step S11 in which a final accumulated value Ds when $ISC_d=0$ is added to the integration portion $ISC_i$ to update the integration portion $ISC_i$.

That is to say, $$ISC_i=ISC_i+Ds\times Kn \quad (3)$$

In the equation (3), $K_D$ denotes a constant.

Thus, as shown in FIG. 3 (D), the integration portion $ISC_i$ is incremented by the addition of the final accumulated value Ds to the integration $ISC_i$.

In a step S12, the control value $ISC_{on}$ is calculated and output in accordance with the equation (3).

In a step S13, the final accumulated value $D_s$ is held until a predetermined interval of time T has passed.

When the proportional portion $ISC_p$ and integration portion $ISC_i$ are updated during the predetermined time T, the control value $ISC_{on}$ is calculated according to the updated value in accordance with the equation (2) so that the pulse train signal based on the control value $ISC_{on}$ is output to the idling control valve 3. It is noted that the predetermined interval of time T is a value preset according to the responsive characteristic of the stepping motor used in the idling control valve 3 and has a different value depending on variations in the individual stepping motors.

In a step S14, the accumulated value Ds is cleared to zero and returns to the start position after the predetermined interval of time has passed.

In the preferred embodiment shown in FIG. 2, the accumulated value is accumulated during the time duration at which the differential portion $ISC_d$ is generated on the basis of the variation speed of the actual revolution speed Ne. The final accumulated value Ds of the differential portion $ISC_d$ is held at a time at which $ISC_d=0$ until the predetermined interval of time T preset according to the responsive characteristic of the idling control valve 3 has passed. During the predetermined interval of time T, the integration portion $ISC_i$ which accords with the final accumulated value Ds is updated to the integration portion $ISC_i$ so as to update the integration portion $ISC_i$. The feedback control according to the PID control is carried out so that the effect caused by the addition of the differential portion to the integration control value can be continued even when the stepping motor which provides the unfavorable responsive characteristic is used for the idling control valve 3. The control responsive characteristic of the idling control valve 3 can, thus, be improved.

As described hereinabove, since the idling speed control apparatus accumulates the differential portion based on the variation speed of the deviation between the actual engine revolution speed and target engine revolution speed so that the final accumulated value is held for the predetermined interval of time, the value which accords with the final accumulated value is added to the integration portion for the predetermined time from the time at which the generation interval of time on the differential portion is ended, and the accumulated value is updated to carry out the proportion-integration-differential (PID) control, the effect of adding the differential portion can be continued and the control responsive characteristic of the idling control valve can be improved.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. An idling speed control system for an internal combustion engine, comprising:

a) an idling control valve whose opening angle is adjusted in response to a control signal, said idling control valve being disposed in an auxiliary air passage bypassing a throttle valve of the engine;

b) basic control value setting means for setting a basic control value of the adjusted opening angle of the idling control valve;

c) proportional control setting means for setting a proportional control value to correct the basic control value so that an actual engine revolution speed approaches a target engine revolution speed, the proportional control value being set on the basis of a difference between the actual revolution speed and target revolution speed;

d) intergration control setting means for setting an integration control value to correct the basic control value so that the actual engine revolution speed approaches the target engine revolution speed, the integration control value being set on the basis of the difference between the actual revolution speed and target revolution speed;

e) differential control setting means for setting a differential control value to correct the basic control value so that the actual engine revolution speed approaches the target engine revolution speed, the differential control value being set on the basis of the variation speed of the actual engine revolution speed;

f) control value calculating means for calculating a control value of the adjusted opening angle of the idling control valve by adding the integration control, proportional control, and differential control values to the basic control value;

g) differential control value accumulating means for accumulating the differential control values during an interval at which the differential control value is set;

h) accumulated value holding means for holding a final accumulated value at a time at which the setting of the differential control value is ended for a predetermined period of time after the time at which the setting of the differential control value is ended; and i) integration updating means for adding the value which accords with the final accumulated value of the differential control value to the integration control value during the predetermined period of time at which the final accumulated value at the time of end of setting the differential control value is held.

2. An idling speed control system for an internal combustion engine as set forth in claim 1, which further includes an engine coolant temperature sensor for detecting an engine coolant temperature of the engine and wherein said basic control value is set on the basis of the engine coolant temperature.

3. An idling speed control system for an internal combustion engine as set forth in claim 2, which further includes engine revolution speed detecting means for detecting the actual engine revolution speed.

4. An idling speed control system for an internal combustion engine as set forth in claim 3, which further includes a switch for operating an air conditioner mounted in a vehicle and outputting an ON or OFF signal when the switch is turned to ON or OFF and wherein said target engine revolution speed is set on the basis of the engine coolant temperature and the ON or OFF signal of the air conditioner.

5. An idling speed control system for an internal combustion engine as set forth in claim 4, wherein said control value calculating means calculates the control value $ISC_{on}$ as follows:

$ISC_{on}=ISC_{tw}+ISC_i+ISC_p+ISC_d$, wherein $ISC_{tw}$ denotes the basic control value, $ISC_i$ denotes the integration control value, $ISC_p$ denotes the proportional control value, and $ISC_d$ denotes the differential control value.

6. An idling speed control system for an internal combustion engine as set forth in claim 5, said updating means updates the integration control value $ISC_i$ as follows:

$ISC_i = ISC_i + Ds \times K_D$, wherein Ds denotes the final accumulated value of the differential control value of $ISC_d$ when $ISC_d = 0$, $Ds = ISC_d + Ds$, and $K_D$ denotes a constant.

7. An idling speed control system for an internal combustion engine as set forth in claim 6, wherein Ds=0 when the predetermined period of time has passed.

8. An idling speed control system for an internal combustion engine as set forth in claim 7, wherein said idling control valve comprises a stepping motor.

9. An idling speed control system for an internal combustion engine as set forth in claim 8, wherein said control signal supplied to the stepping motor is a pulse train signal having the control value $ISC_{on}$.

10. An idling speed control method for an internal combustion engine, comprising the steps of:

a) basic control value setting means for setting a basic control value of an adjusted opening angle of an idling speed control valve, said idling speed control valve being disposed in an auxiliary air passage bypassing an engine throttle valve for controlling an auxiliary air quantity during an engine idling condition;

b) setting a proportional control value to correct the basic control value so that an actual engine revolution speed approaches a target engine revolution speed, the proportional control value being set on the basis of a difference between the actual revolution speed and target revolution speed;

c) setting an integration control value to correct the basic control value so that the actual engine revolution speed approaches the target engine revolution speed, the integration control value being set on the basis of the difference between the actual revolution speed and target revolution speed;

d) setting a differential control value to correct the basic control value so that the actual engine revolution speed approaches the target engine revolution speed, the differential control value being set on the basis of the variation speed of the actual engine revolution speed;

e) calculating a control value of the adjusted opening angle of the idling control valve by adding the integration control, proportional control, and differential control values to the basic control value;

f) accumulating the differential control values during an interval at which the differential control value is set;

g) holding a final accumulated value at a time at which the setting of the differential control value is ended for a predetermined period of time after the time at which the setting of the differential control value is ended; and h) adding the value which accords with the final accumulated value of the differential control value to the integration control value during the predetermined period of time at which the final accumulated value at the time of setting end of the differential control value is held.

* * * * *